US007452106B2

(12) United States Patent
Tseng

(10) Patent No.: US 7,452,106 B2
(45) Date of Patent: Nov. 18, 2008

(54) CIRCUIT DEVICE FOR CONTROLLING A PLURALITY OF LIGHT-EMITTING DEVICES IN A SEQUENCE

(76) Inventor: Shen Ko Tseng, No.187, Lane 75, Sec. 3, Kangning Rd., Neihu District, Taipei City 114 (TW)

( * ) Notice: Subject to any disclaimer, the term of this patent is extended or adjusted under 35 U.S.C. 154(b) by 51 days.

(21) Appl. No.: 11/567,110

(22) Filed: Dec. 5, 2006

(65) Prior Publication Data

US 2008/0130269 A1 Jun. 5, 2008

(51) Int. Cl.
*F21V 21/08* (2006.01)

(52) U.S. Cl. ..... 362/276; 362/103; 362/105; 362/267

(58) Field of Classification Search ..... 362/103, 362/105, 276, 802, 267, 158, 249; 2/209.13; 315/209, 185 R
See application file for complete search history.

(56) References Cited

U.S. PATENT DOCUMENTS 5,371,662 A * 12/1994 Shen-Ko ..... 362/276
5,813,148 A * 9/1998 Guerra ..... 36/137
5,947,580 A * 9/1999 Chien ..... 362/84
6,485,169 B1 * 11/2002 Ragner ..... 362/500
6,733,150 B1 * 5/2004 Hanley ..... 362/106
6,789,913 B2 * 9/2004 Wei ..... 362/103
6,824,291 B2 * 11/2004 Vautrin et al. ..... 362/156
7,207,688 B2 * 4/2007 Yuen et al. ..... 362/103

FOREIGN PATENT DOCUMENTS

JP 407191386 * 7/1995

* cited by examiner

*Primary Examiner*—Ali Alavi
(74) *Attorney, Agent, or Firm*—Banger Shia

(57) ABSTRACT

The invention provides a circuit device for controlling N light-emitting devices disposed in a sequence on an object, wherein N is an integer larger than 1, and each light-emitting device includes a respective light-emitting diode. The circuit device includes a water-proof enclosure, a motion-actuated switch, a controller, and a battery. Particularly, the controller is capable of driving the light-emitting diodes lighting up on the basis of a first predefined sequence and a consequent second predefined sequence when triggered by the motion-actuated switch.

15 Claims, 8 Drawing Sheets

The first pre-defined lighting sequence

| LED | 4a | 4b | 4c | 4d | 4e |
|---|---|---|---|---|---|
| Flashing period (sec.) | 0.1 | 0.1 | 0.1 | 0.1 | 0.1 |

The signal pattern of the first pre-defined lighting sequence

The second pre-defined lighting sequence

| LED | 4a | 4b | 4c | 4d | 4e |
|---|---|---|---|---|---|
| Flashing period (sec.) | 0.05 | 0.5 | 1 | 2 | 2.5 |

The signal pattern of the second pre-defined lighting sequence

CIRCUIT DEVICE FOR CONTROLLING A PLURALITY OF LIGHT-EMITTING DEVICES IN A SEQUENCE

BACKGROUND OF THE INVENTION

1. Field of the Invention

The present invention relates generally to a circuit device and, more particularly, to a circuit device for controlling a plurality of light-emitting devices in a sequence.

2. Description of the Prior Art

Poor illumination at night is a set back to night activities. There may be problems of difficult identification and safety. People jogging or cycling at night may be hit by cars due to insufficient illumination. Playing balls in open places may have to be stopped at night if the street lights are not strong enough. It is, therefore, necessary to find means to enhance the safety and smooth-going of night activities.

Footwear with flashing device is available on the market for reasons of safety described above. Such footwear typically includes at least one light source such as light emitting diodes (LEDs), a source of power such as a battery, and a switch to connect the battery to the light sources to illuminate them.

In addition, the switch could be a simple manual switch as disclosed, for example, in U.S. Pat. No. 4,158,922. The switch could be a mercury switch in which a ball of mercury runs back and forth along a tube between a pair of electrical contacts during motion of the footwear, as disclosed in U.S. Pat. No. 4,848,009. The switch can be a pressure responsive switch which opens and closes in response to application of the wearer's weight on the switch as disclosed, for example, in U.S. Pat. No. 5,285,586. The switch can also be a spring switch in which a cantilevered spring in the form of a coil oscillates back and forth to make and break contact with an electrical terminal as, for example, shown in U.S. Pat. No. 5,408,764.

Moreover, to increase battery life and to provide a more attractive eye-catching and safer display, it is desirable to cause the lights to flash on and off, rather than being maintained continuously illuminated while the switch is closed. Such flash will be interesting and attractive if an eye-catching flashing pattern could be demonstrated from the LEDs.

Furthermore, to prevent the aforesaid device from water and dust, so as to extend the lifetime of such device, the system-in-package of the battery, the responsive switch, and the control circuit of the LEDs is also desired.

SUMMARY OF THE INVENTION

Accordingly, the aspect of the present invention is to provide a circuit device, and more particularly, to provide a circuit device for controlling a plurality of light-emitting devices in a sequence. The circuit device of the invention is capable of controlling a plurality of light-emitting devices lighting sequentially to generate an attractive pattern. Furthermore, the circuit device of the present invention is compact, and it provides strong illumination in an energy saving way.

In a preferred embodiment of the invention, the circuit device is used to control N light-emitting devices sequentially disposed on an object, and N is an integer larger than 1. Moreover, each of the light-emitting devices includes a light-emitting diode.

The circuit device includes a water-proof enclosure, a motion-actuated switch, a controller, and a battery. The water-proof enclosure is embedded in the object. Moreover, the motion-actuated switch is mounted in the water-proof enclosure, for triggering the controller in response to a motion of the object. Furthermore, the battery is mounted in the water-proof enclosure, for supplying the circuit device with electrical power.

The controller is also mounted in the water-proof enclosure. Furthermore, the controller is electrically connected to the motion-actuated switch and each of the N light-emitting diodes, for driving the N light-emitting diodes lighting based on a first pre-defined lighting sequence and a following second pre-defined lighting sequence when triggered by the motion-actuated switch.

Furthermore, in the first pre-defined lighting sequence the N light-emitting diodes lighting sequentially and, the flashing period for each light emitting diode is equal, and in the second pre-defined lighting sequence is the N light-emitting diodes lighting sequentially and the flashing period for each light emitting diode is gradually increased.

In another preferred embodiment of the invention, the circuit device is also used to control N light-emitting devices sequentially disposed on an object, and N is an integer larger than 1. Moreover, each of the light-emitting devices includes a light-emitting diode. The circuit device includes a water-proof enclosure, a motion-actuated switch, a controller, and a battery.

The water-proof enclosure is embedded in the object. Moreover, the motion-actuated switch is mounted in the water-proof enclosure, for generating a first triggering signal in response to a motion of the object.

The controller is mounted in the water-proof enclosure, for driving the N light-emitting diodes lighting based on a first pre-defined lighting sequence and a following second pre-defined lighting sequence when the controller receives the first triggering signal. Particularly, the lighting frequency of the first pre-defined lighting sequence is fixed, and the lighting frequency of the second pre-defined lighting sequence is changed gradually.

The battery is also mounted in the water-proof enclosure for supplying said circuit device with electrical power. Furthermore, when the N light-emitting diodes are driven by the controller, if the motion-actuated switch generates a second triggering signal in response to another motion of the object, the controller re-drives the N light-emitting diodes starting from the first pre-defined lighting sequence to the second pre-defined lighting sequence.

In yet another preferred embodiment of the invention, the circuit device is also used to control N light-emitting devices sequentially disposed on an object, and N is an integer larger than 1. Moreover, each of the light-emitting devices includes a light-emitting diode. In addition, the circuit device includes a water-proof enclosure, a motion-actuated switch, a controller, a detector, and a battery.

The water-proof enclosure is embedded in the object, whereas the motion-actuated switch is mounted in the water-proof enclosure, for generating a first triggering signal in response to a motion of the object.

The controller is also mounted in the water-proof enclosure, for driving the N light-emitting diodes lighting based on a first pre-defined lighting sequence and a following second pre-defined lighting sequence when the controller receives the first triggering signal. Moreover, the lighting frequency of the first pre-defined lighting sequence is fixed, and the lighting frequency of the second pre-defined lighting sequence is changed gradually.

Furthermore, the detector is also mounted in the water-proof enclosure, for generating a reset signal after receiving a second triggering signal from the motion-actuated switch, the motion-actuated switch generating the second triggering signal in response to another motion of the object happened during the period when the N light-emitting diodes are driven. Moreover, the battery is also mounted in the water-proof enclosure for supplying said circuit device with electrical power.

Particularly, the controller, after receives the reset signal, re-drives the N light-emitting diodes starting from the first pre-defined lighting sequence to the second pre-defined lighting sequence.

The objective of the present invention will no doubt become obvious to those of ordinary skill in the art after reading the following detailed description of the preferred embodiment, which is illustrated in the various figures and drawings.

BRIEF DESCRIPTION OF THE APPENDED DRAWINGS

DETAILED DESCRIPTION OF THE INVENTION

Figure 1:
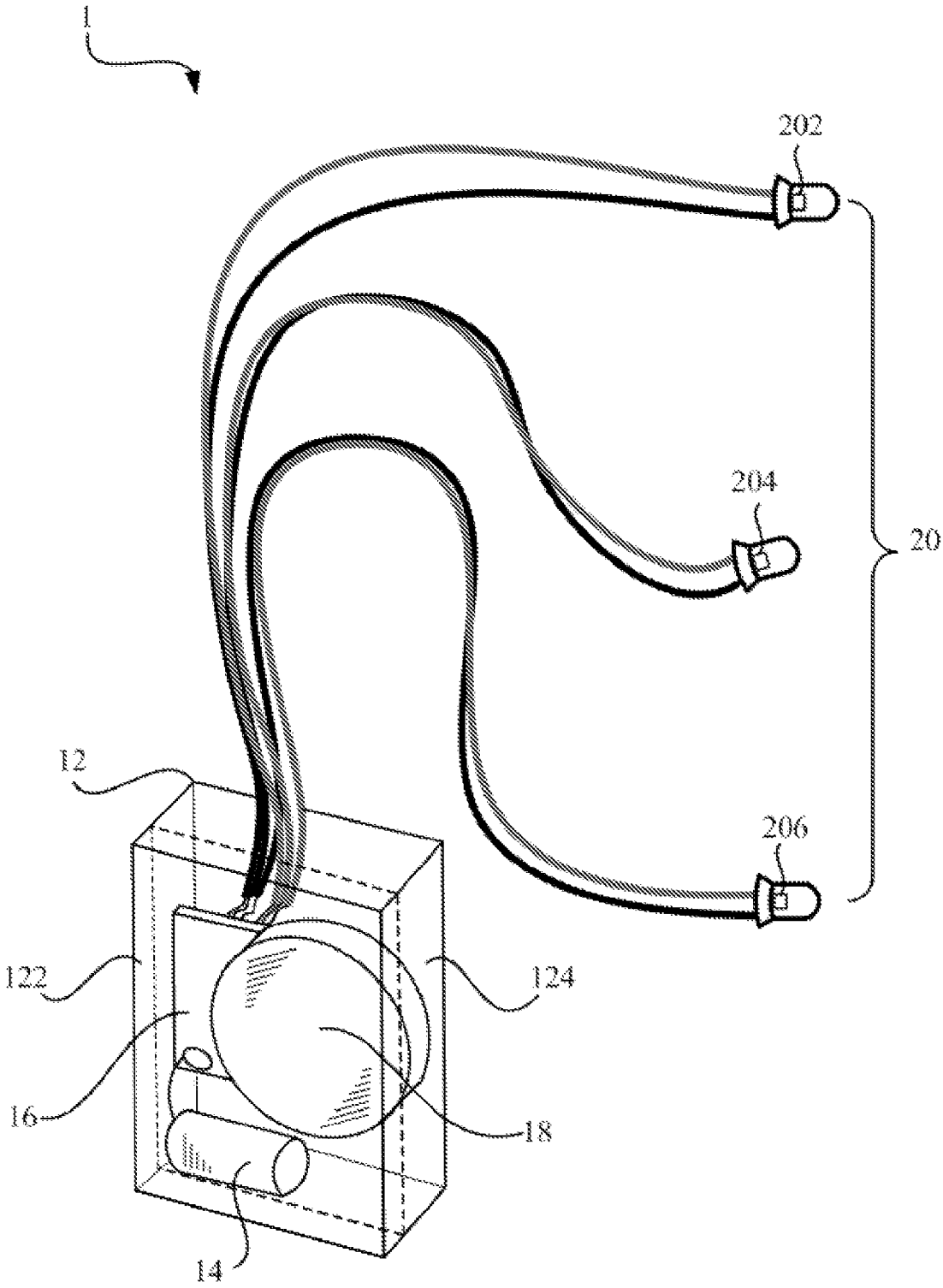
FIG. 1 illustrates a circuit device of an embodiment of the invention.

Please refer to FIG. 1. FIG. 1 shows an three dimensional diagram of a circuit device of an embodiment of the present invention. The circuit device 1 is applied to control N light-emitting devices 20 sequentially disposed on an object (not shown), and N is an integer larger than 1. As shown in FIG. 1, in the embodiment, N is equal to 3. Additionally, each of the light-emitting devices includes a light-emitting diode (LED) 202, 204, 206.

In practice, the LED can be a red LED, a blue LED, a green LED, a yellow LED or other suitable LED.

As shown in FIG. 1, the circuit device 1 includes a water-proof enclosure 12, a motion-actuated switch 14, a controller 16, and a battery 18.

According to the invention, the water-proof enclosure 12 is embedded in the object. The water-proof enclosure 12 can keep the circuit device 1 from being humidify, being oxidized, or being contaminated, further elongating the life of the circuit device 1. Furthermore, the water-proof enclosure 12 includes a plastic container 124 and an upper plastic cover 122 bonded to the plastic container 124. Moreover, the upper plastic cover 122 can be fused to the circumference of the plastic container 124 by supersonic wave or laser. Additionally, in practice, the water-proof enclosure can be formed by injection molding of resin or plastic.

The motion-actuated switch 14 is mounted in the water-proof enclosure 12, for triggering the controller 16 in response to a motion of the object. Moreover, the battery 18 is also mounted in the water-proof enclosure 12, for supplying the circuit device 1 with electrical power.

In addition, the controller 16 is also mounted in the water-proof enclosure 12. Furthermore, the controller 16 is electrically connected to the motion-actuated switch 14 and each of the N light-emitting diodes respectively, for driving the N light-emitting diodes lighting based on a first pre-defined lighting sequence and a following second pre-defined lighting sequence when triggered by the motion-actuated switch 14.

Figure 2A:
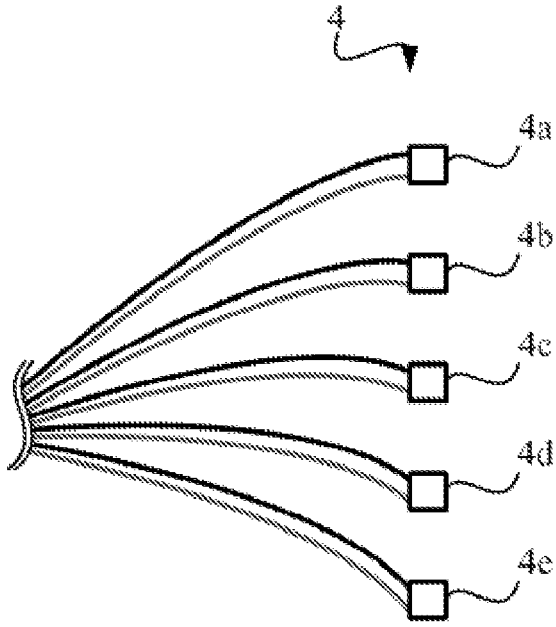
FIG. 2A illustrates a light-emitting device of an embodiment of the invention.
Figure 2B:
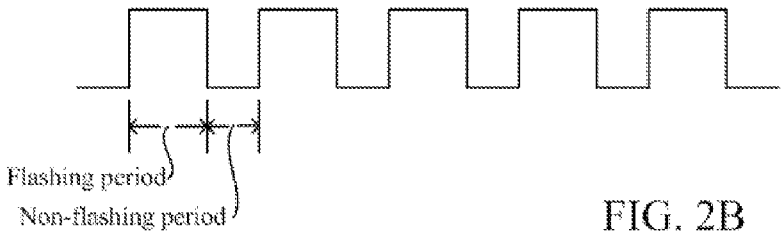
FIG. 2B shows the first pre-defined lighting sequence of the invention.
Figure 2C:
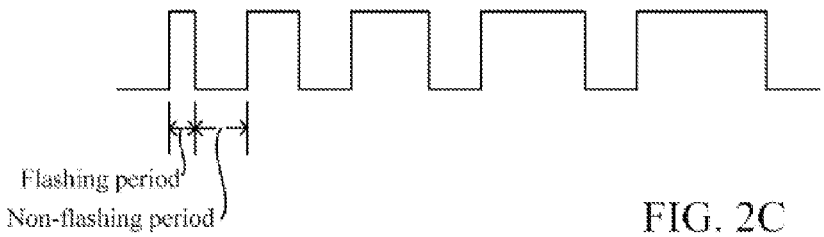
FIG. 2C shows the second pre-defined lighting sequence of the invention.

Please further refer to FIG. 2A, FIG. 2B, and FIG. 2C; FIG. 2A illustrates a light-emitting device 4 of an embodiment of the invention, and FIG. 2B shows the first pre-defined lighting sequence of the light-emitting device 4 of FIG. 2A, and FIG. 2C shows the second pre-defined lighting sequence of the light-emitting device 4 of FIG. 2A. As shown in FIG. 2A, the light-emitting device 4 includes 5 light-emitting diodes 4*a*, 4*b*, 4*c*, 4*d*, and 4*e* arranged sequentially.

Additionally, as shown in FIG. 2B, the first pre-defined lighting sequence is that the 5 LEDs 4*a*, 4*b*, 4*c*, 4*d*, and 4*e* lights up sequentially, and the flashing period for each of the 5 LEDs is equal. For example, if the flashing period for the first LED 4*a* is 0.1 sec., the flashing period for the second LED 4*b* is also 0.1 sec.

That is to say, in the embodiment, the first pre-defined lighting sequence is the first LED 4*a* lighting up for 0.1 sec., afterward the second LED 4*b* lights up for 0.1 sec., afterward the third LED 4*c* lights up for 0.1 sec., afterward the fourth LED 4*d* lights up for 0.1 sec., and afterward the fifth LED 4*e* lights up for 0.1 sec. Additionally, the signal pattern of the driving signal generated by the controller based on the first pre-defined lighting sequence is also shown in FIG. 2B.

Furthermore, as shown in FIG. 2C, in the second pre-defined lighting sequence the 5 LEDs 4*a*, 4*b*, 4*c*, 4*d*, and 4*e* lights up sequentially, and the flashing period for each of the 5 LEDs is gradually increased. For example, if the flashing period for the first LED 4*a* is 0.05 sec., the flashing period for the second LED 4*b* is increased to 0.5 sec., and the flashing period for the third LED 4*c* is increased to 1 sec.

That is to say, in the embodiment, the second pre-defined lighting sequence is that the first LED 4*a* first lights up for 0.05 sec., afterward the second LED 4*b* lights up for 0.5 sec., afterward the third LED 4*c* lights up for 1 sec., afterward the fourth LED 4*d* lights up for 2 sec., and afterward the fifth LED 4*e* lights up for 2.5 sec.

In another embodiment, the first pre-defined lighting sequence can be that the LEDs lights up sequentially, and the non-flashing period for each LEDs is equal. For example, if there are four LEDs, the first pre-defined lighting sequence is that the first LED lights up; after 0.1 sec., the second LED lights up; after 0.1 sec., the third LED lights up; and after 0.1 sec., the fourth LED lights up.

In another embodiment, the second pre-defined lighting sequence can be that the LEDs lights up sequentially, and the non-flashing period for each LEDs is gradually increased. For example, if there are four LEDs, the second pre-defined lighting sequence is that the first LED lights up; after 0.1 sec., the second LED lights up; after 1 sec., the third LED lights up; and after 10 sec., the fourth LED lights up.

Practically, the circuit device of the invention can drive the light-emitting device lighting based on the first and the second pre-defined lighting sequences for only one time. Therefore, the circuit device needs the motion-actuated switch to sense another motion of the object before triggering the controller to drive the light-emitting device lighting again. Accordingly, the circuit device can drive the light-emitting device lighting in an energy-saving way.

It should be noted that the first and second pre-defined lighting sequences described above are only some examples of the present invention; the lighting sequence of the present invention can be applied in other suitable lighting sequences. Moreover, the circuit device of the invention can optionally drive the light-emitting device to light continuously for several times.

Figure 3:
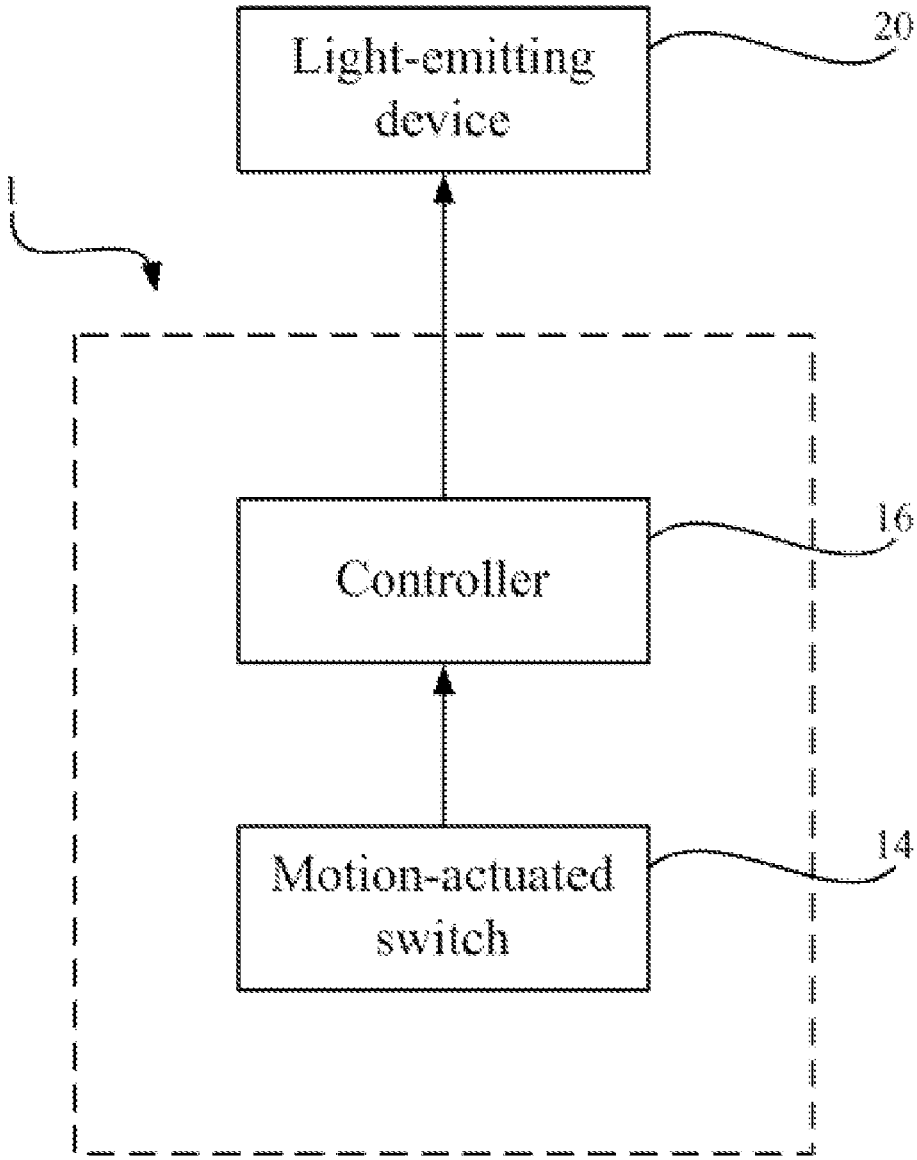
FIG. 3 is a function block of a circuit device of an embodiment of the invention.

Please refer to FIG. 3; FIG. 3 shows a function block of a circuit device of an embodiment of the invention. In the embodiment, when the light-emitting device 20 lights up in accordance with the first pre-defined lighting sequence and the second pre-defined lighting sequence as described above, if the motion-actuated switch 14 senses a motion of the object and then generates a second triggering signal in response to the motion of the object to trigger the controller 16, the controller 16 re-drives the N LEDs of the light-emitting device 20 starting from the first pre-defined lighting sequence and the second pre-defined lighting sequence. In addition, it should be noticed that the circuit device of the prior art did not have the re-driving mechanism of the invention as described above.

Figure 4:
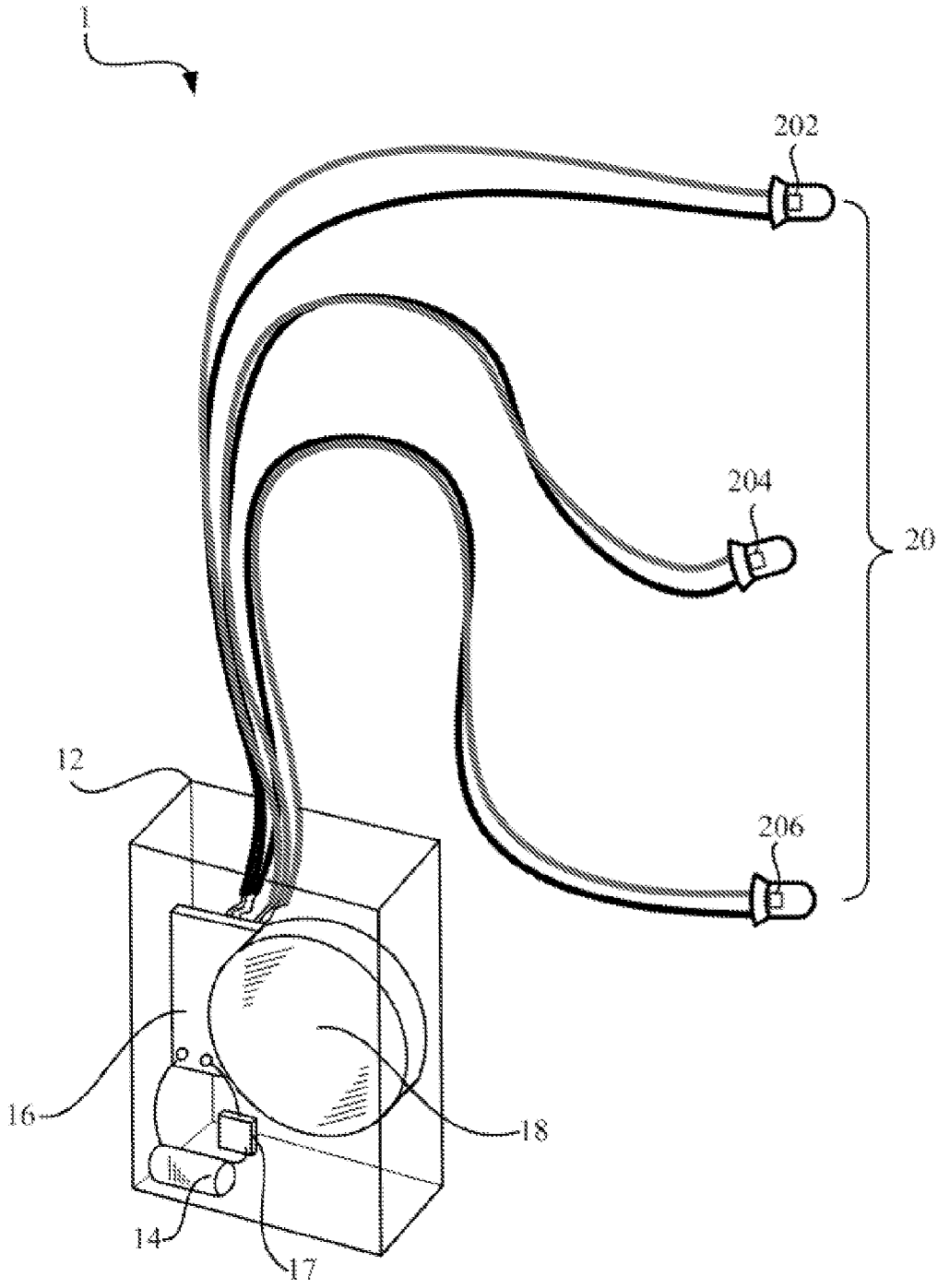
FIG. 4 illustrates a circuit device of an embodiment of the invention.
Figure 5:
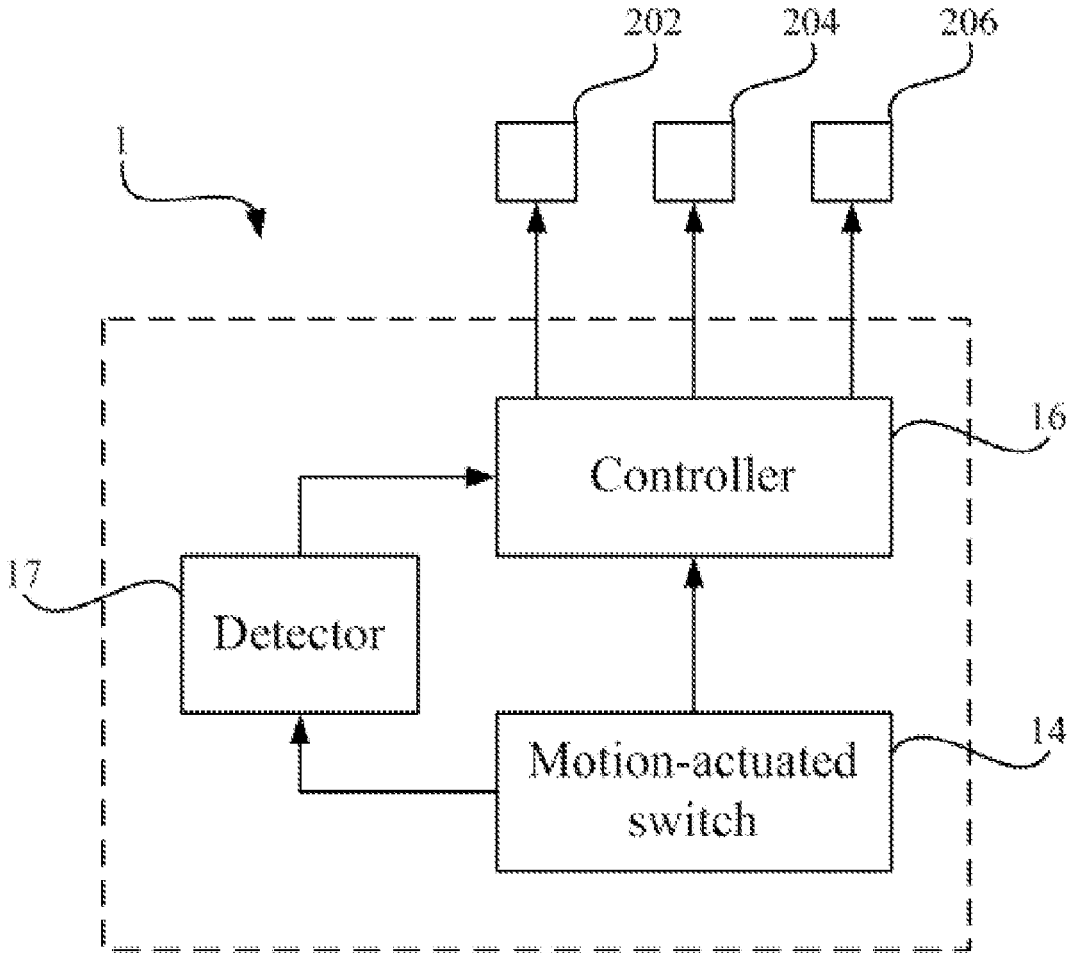
FIG. 5 is a function block of a circuit device of an embodiment of the invention.

Please refer to FIG. 4 and FIG. 5; FIG. 4 illustrates a circuit device of an embodiment of the invention, whereas FIG. 5 shows a function block of the circuit device. The circuit device 1 is applied to control N light-emitting devices 20 disposed on an object (not shown); N is an integer larger than 1, and each of the N light-emitting device comprises a LED.

As shown in FIG. 4, the circuit device 1 includes a water-proof enclosure 12, a motion-actuated switch 14, a controller 16, a detector 17, and a battery 18. Moreover, in the embodiment, N is equal to 3.

The water-proof enclosure 12 is embedded in the object, and the motion-actuated switch 14, the controller 16, the detector 17, and the battery 18 are all mounted in the water-proof enclosure 12. The motion-actuated switch 14 can generate a first triggering signal in response to a motion of the object. Moreover, the battery 18 is used to supply the circuit device 1 with electrical power.

Furthermore, the controller 16 is used to drive the LEDs 202, 204, and 206 lighting based on a first pre-defined lighting sequence and a following second pre-defined lighting sequence when it receives the first triggering signal. Particularly, the lighting frequency of the first pre-defined lighting sequence is fixed, and the lighting frequency of the second pre-defined lighting sequence is changed gradually. For example, the lighting frequency of the second pre-defined lighting sequence can be gradually increased or decreased.

As shown in FIG. 5, the detector 17 is electrically connected to the motion-actuated switch 14 and the controller 16 respectively, and the detector 17 can detect if the motion-actuated switch 14 generates a second trigger signal to selectively generate a reset signal when the controller 16 drives the LEDs 202, 204, and 206 lighting, and then the reset signal is transmitted to the controller 16. In detail, the motion-actuated switch 14 generates the second triggering signal in response to another motion of the object happened during the period when the N light-emitting diodes are driven.

Particularly, in the embodiment, when the controller 16 drives the LEDs 202, 204, and 206 to light up, if the controller 16 receives the reset signal, the controller 16 re-drives the LEDs 202, 204, and 206 starting from the first pre-defined lighting sequence and the second pre-defined lighting sequence.

Additionally, the object of the invention can be, but not limited to, shoes, such as casual shoes, sports shoes, and leather shoes; a garment, such as a jacket, a vest, a rain coat, and sportswear; an accessory, such as a handbag, a rucksack, a belt, a watch, and a cap.

Figure 6:
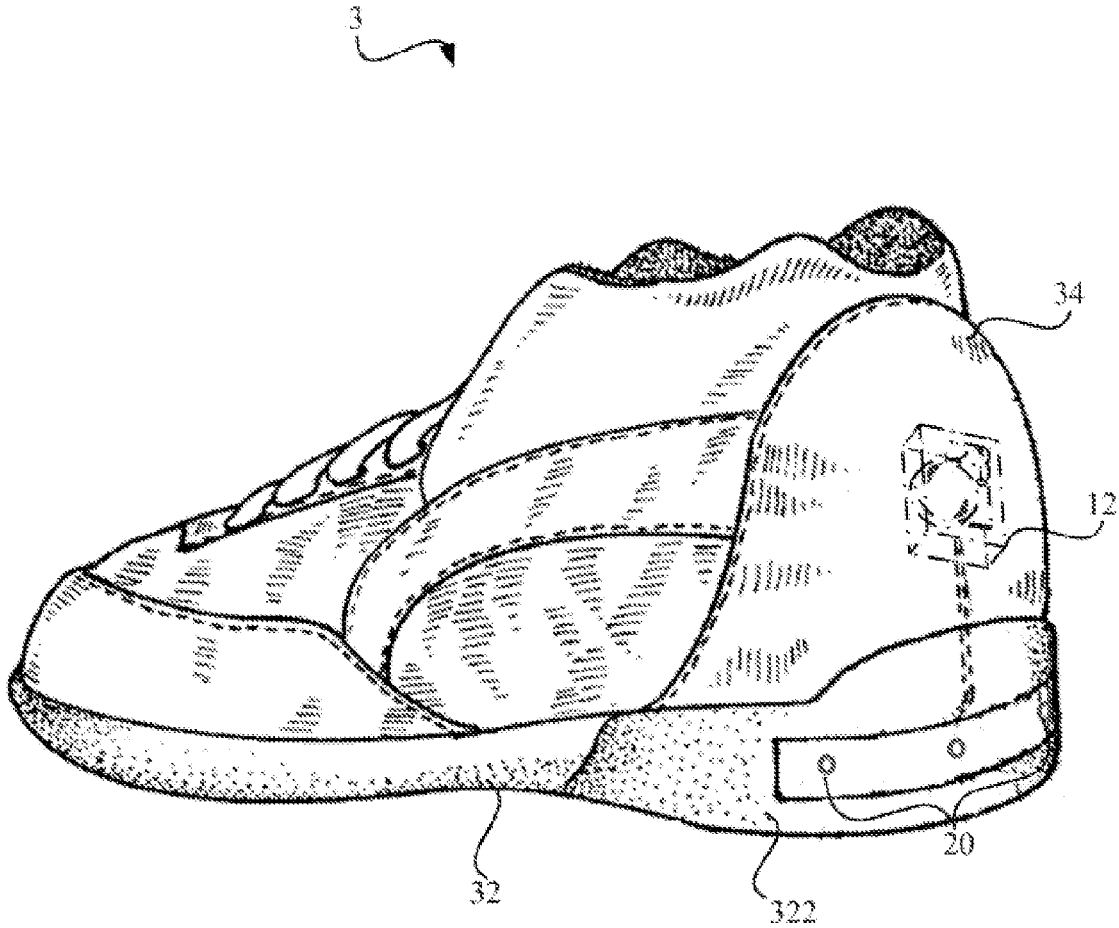
FIG. 6 illustrates the circuit device of an embodiment of the present invention disposed in footwear.

Please refer to FIG. 6, which shows a schematic diagram of the circuit device disposed on a shoe 3. As shown in FIG. 6, the light-emitting devices 20 are disposed in a heel portion 322 of the sole 32, whereas the water-proof enclosure 12 of the present invention is disposed in a back portion 34. When the wearer walks or runs, the motion-actuated switch will trigger the controller for driving the light-emitting devices 20 lighting/flashing based on the first and second pre-defined lighting sequence as described above. Furthermore, the lighting or flashing of the light-emitting devices 20 provides strong and safe illumination when the wearer walks or runs at night.

Figure 7:
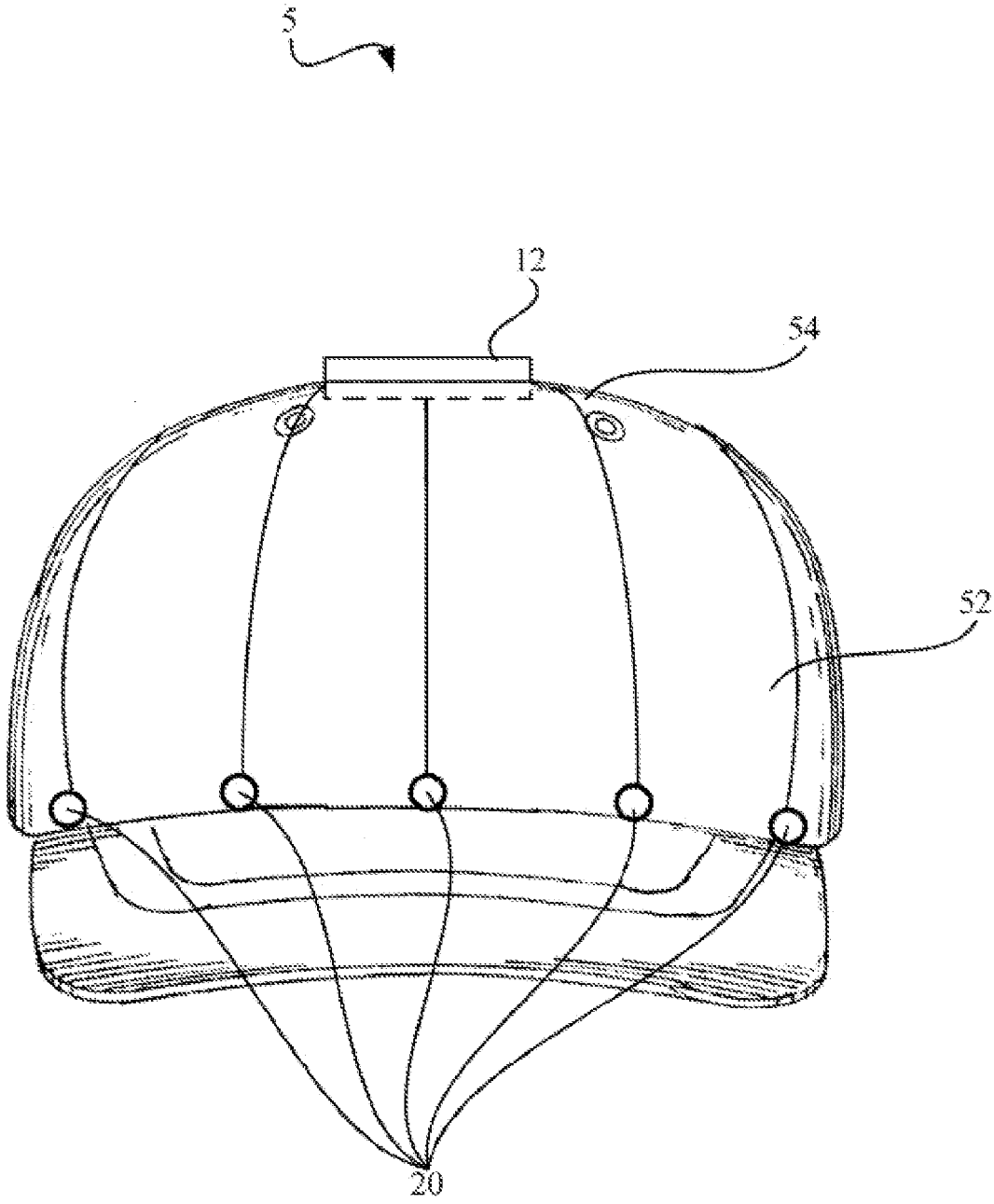
FIG. 7 illustrates the circuit device of an embodiment of the present invention disposed in a hat.

Please refer to FIG. 7, which shows a schematic diagram of the circuit device disposed on a cap 5. As shown in FIG. 7, the light-emitting device 20 is disposed on the front portion 52 of the cap 5, whereas the water-proof enclosure 12 and the other devices therein are disposed on the top portion 54 of the cap 5. When the wearer walks or runs, the motion-actuated switch is capable of triggering the controller for driving the light-emitting devices 20 lighting/flashing based on at least a pre-defined lighting sequence, such as the first and second pre-defined lighting sequence as described above.

Obviously, when the LEDs of the invention light up sequentially, an attractive pattern can be generated. Additionally, the circuit of the present invention is compact, energy saving, and may be adapted for use in many different objects and articles to provide strong illumination for night activities.

Although the present invention has been illustrated and described with reference to the preferred embodiment thereof, it should be understood that it is in no way limited to the details of such embodiment but is capable of numerous modifications within the scope of the appended claims.

What is claimed is:

1. A circuit device for controlling N light-emitting devices disposed on an object, N being an integer larger than 1, and each of the N light-emitting device comprising a light-emitting diode, said circuit device comprising:

a water-proof enclosure embedded in the object;

a motion-actuated switch, mounted in the water-proof enclosure, for triggering a controller in response to a motion of the object;

the controller, mounted in the water-proof enclosure, electrically connected to the motion-actuated switch and each of the light-emitting diodes, for driving the N light-emitting diodes lighting based on a first pre-defined lighting sequence and a second pre-defined lighting sequence followed the first pre-defined lighting sequence when triggered by the motion-actuated switch; and a battery, mounted in the water-proof enclosure, for supplying said circuit device with electrical power;

wherein in the first pre-defined lighting sequence the N light-emitting diodes lighting sequentially and the flashing period for each light emitting diode is equal, and in the second pre-defined lighting sequence is the N light-emitting diodes lighting sequentially and the flashing period for each light emitting diode is gradually increased.

2. The circuit device of claim 1, wherein each of the light-emitting diode is selected from a group consisting of: a red light-emitting diode, a blue light-emitting diode, a green light-emitting diode, and a yellow light-emitting diode.

3. The circuit device of claim 1, wherein the object is one selected from the group consisting of: a shoe, a garment, a handbag, a rucksack, and a cap.

4. The circuit device of claim 1, wherein the water-proof enclosure is an insert molded water-proof enclosure formed of resin or plastic.

5. The circuit device of claim 1, wherein the water-proof enclosure comprises a plastic container and an upper plastic cover for covering the plastic container.

6. The circuit device of claim 5, wherein the upper plastic cover is fused to the plastic container.

7. The circuit device of claim 6, wherein the upper plastic cover is fused to the circumference of the plastic container by supersonic wave or laser.

8. A circuit device for controlling N light-emitting devices disposed on an object, N being an integer larger than 1, and each of the N light-emitting device comprising a light-emitting diode, said circuit device comprising:

a water-proof enclosure embedded in the object;

a motion-actuated switch, mounted in the water-proof enclosure, for generating a first triggering signal in response to a motion of the object;

a controller, mounted in the water-proof enclosure, for driving the N light-emitting diodes lighting based on a first pre-defined lighting sequence and a second pre-defined lighting sequence followed the first pre-defined lighting sequence when the controller receives the first triggering signal, wherein the lighting frequency of the first pre-defined lighting sequence is fixed, and the lighting frequency of the second pre-defined lighting sequence being changed gradually; and a battery, mounted in the water-proof enclosure, for supplying said circuit device with electrical power;

wherein when the N light-emitting diodes are driven by the controller, if the motion-actuated switch generating a second triggering signal in response to another motion of the object, the controller re-driving the N light-emitting diodes starting from the first pre-defined lighting sequence to the second pre-defined lighting sequence.

9. The circuit device of claim 8, wherein each of the light-emitting diode is selected from a group consisting of: a red light-emitting diode, a blue light-emitting diode, a green light-emitting diode, and a yellow light-emitting diode.

10. The circuit device of claim 8, wherein the object is one selected from the group consisting of: a shoe, a garment, a handbag, a rucksack, and a cap.

11. The circuit device of claim 8, wherein the water-proof enclosure is an insert molded water-proof enclosure formed of resin or plastic.

12. The circuit device of claim 8, wherein the water-proof enclosure comprises a plastic container and an upper plastic cover for covering the plastic container.

13. The circuit device of claim 12, wherein the upper plastic cover is fused to the plastic container.

14. The circuit device of claim 13, wherein the upper plastic cover is fused to the circumference of the plastic container by supersonic wave or laser.

15. A circuit device for controlling N light-emitting devices disposed on an object, N being an integer larger than 1, and each of the N light-emitting device comprising a light-emitting diode, said circuit device comprising:

a water-proof enclosure embedded in the object;

a motion-actuated switch, mounted in the water-proof enclosure, for generating a first triggering signal in response to a motion of the object;

a controller, mounted in the water-proof enclosure, for driving the N light-emitting diodes lighting based on a first pre-defined lighting sequence and a second pre-defined lighting sequence followed the first pre-defined lighting sequence when receiving the first triggering signal, wherein the lighting frequency of the first pre-defined lighting sequence is fixed, and the lighting frequency of the second pre-defined lighting sequence being gradually increased;

a detector, mounted in the water-proof enclosure, for generating a reset signal after receiving a second triggering signal from the motion-actuated switch, the motion-actuated switch generating the second triggering signal in response to another motion of the object happened during the period when the N light-emitting diodes are driven; and a battery, mounted in the water-proof enclosure, for supplying said circuit device with electrical power;

wherein the controller, after receiving the reset signal, re-driving the N light-emitting diodes starting from the first pre-defined lighting sequence to the second pre-defined lighting sequence.

* * * * *